US010985535B2

(12) United States Patent
Araki et al.

(10) Patent No.: US 10,985,535 B2
(45) Date of Patent: Apr. 20, 2021

(54) METHOD FOR MANUFACTURING SPARK PLUG WITH PERIPHERAL EDGE OF PROXIMAL END SURFACE OF SEALING DISTAL-END LAYER PREVENTED FROM SIGNIFICANTLY RISING TOWARD PROXIMAL END

(71) Applicant: DENSO CORPORATION, Kariya (JP)

(72) Inventors: Hiroshi Araki, Kariya (JP); Naoto Hayashi, Kariya (JP); Hikaru Takashima, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/936,778

(22) Filed: Jul. 23, 2020

(65) Prior Publication Data

US 2021/0028606 A1 Jan. 28, 2021

(30) Foreign Application Priority Data

Jul. 26, 2019 (JP) ..... JP2019-137442

(51) Int. Cl.

| | |
|---|---|
| ***H01T 13/34*** | (2006.01) |
| ***H01T 13/32*** | (2006.01) |
| ***H01T 13/41*** | (2006.01) |
| ***H01T 21/02*** | (2006.01) |
| ***H01T 13/20*** | (2006.01) |

(52) U.S. Cl.

CPC ..... *H01T 21/02* (2013.01); *H01T 13/20* (2013.01); *H01T 13/34* (2013.01); *H01T 13/41* (2013.01)

(58) Field of Classification Search

CPC ..... H01T 21/02; H01T 13/20; H01T 13/34; H01T 13/32; H01T 13/41

See application file for complete search history.

(56) References Cited

U.S. PATENT DOCUMENTS

| | | | | |
|---|---|---|---|---|
| 2005/0093411 | A1* | 5/2005 | McMurray | H01T 13/34 313/136 |
| 2006/0220510 | A1 | 10/2006 | Shibata | |
| 2018/0183216 | A1* | 6/2018 | Uegaki | H01T 13/34 |

* cited by examiner

*Primary Examiner* — Tracie Y Green

(74) *Attorney, Agent, or Firm* — Nixon & Vanderhye P.C.

(57) ABSTRACT

In a method for manufacturing a spark plug, a space on a proximal end side of a center electrode in a shaft hole of an insulator is filled with first electrically conductive glass powder. A space on the proximal end side of the first electrically conductive glass powder in the shaft hole is filled with resistor composition powder. A space on the proximal end side of the resistor composition powder in the shaft hole is filled with second electrically conductive glass powder. The first electrically conductive glass powder, the resistor composition powder, and the second electrically conductive glass powder are sintered in the shaft hole. Prior to filling of the resistor composition powder, at least one of the insulator and the first electrically conductive glass powder is placed in an uncharged state, or the insulator and the first electrically conductive glass powder are placed in the same charged state.

5 Claims, 4 Drawing Sheets

11
A
212
2
21
31
3
41a
8a
42a
10
5
42
8
41
X

METHOD FOR MANUFACTURING SPARK PLUG WITH PERIPHERAL EDGE OF PROXIMAL END SURFACE OF SEALING DISTAL-END LAYER PREVENTED FROM SIGNIFICANTLY RISING TOWARD PROXIMAL END

CROSS-REFERENCE TO RELATED APPLICATION

This application is based on and claims the benefit of priority from earlier Japanese Patent Application No. 2019-137442 filed Jul. 26, 2019, the description of which is incorporated herein by reference.

BACKGROUND

Technical Field

The present disclosure relates to a method for manufacturing a spark plug.

Related Art

In a known method for manufacturing a spark plug, first, a center electrode is inserted into a shaft hole of an insulator. Next, the shaft hole is filled with first electrically conductive glass powder, resistor composition powder for forming the resistor, and second electrically conductive glass powder, and then a terminal fitting is inserted into the shaft hole.

Subsequently, the powder in the shaft hole of the insulator is softened with heat, and the terminal fitting is pressed toward the distal end (in other words, toward the center electrode) by hot pressing. The softened powder is cooled and solidified, and a first sealing layer, the resistor, and a second sealing layer, which are sintered bodies, are formed between the center electrode and the terminal fitting in the shaft hole of the insulator in this order from the distal end side.

DESCRIPTION OF SPECIFIC EMBODIMENTS

Figure 1:
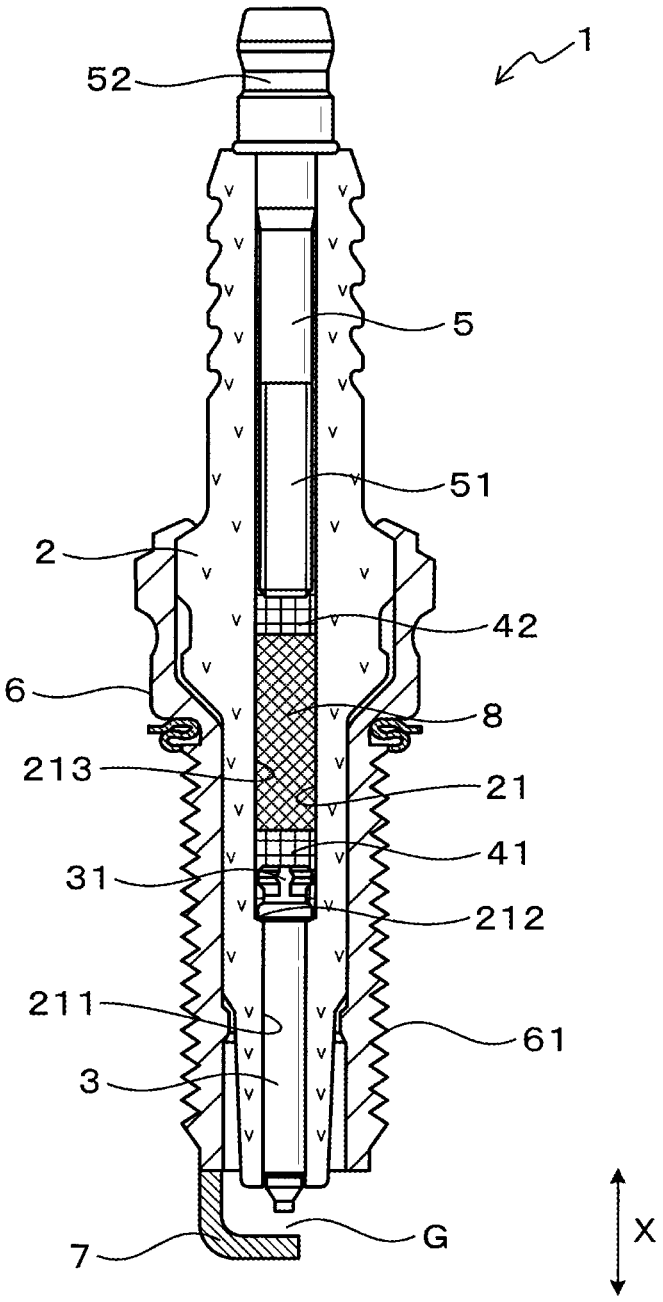
FIG. 1 is a cross-sectional view including an illustration of a center axis of a spark plug according to a first embodiment.

In the spark plug manufactured according to the above known method as disclosed in JP-A-2010-135345, there may be cases where the insulator is charged by friction that occurs, for example, during transportation of the insulator as an individual piece. Thus, in the case of manufacturing a spark plug using the charged insulator, upon filling the shaft hole of the insulator with the first electrically conductive glass powder for forming the first sealing layer, a portion of the electrically conductive glass powder may be electrically adsorbed on the inner wall of the insulator. If this occurs, there is a risk that the peripheral edge of a proximal end surface of the first sealing layer may be formed in such a shape as to significantly protrude toward the proximal end after sintering.

When the peripheral edge of the proximal end surface of the first sealing layer is formed in such a shape as to significantly protrude toward the proximal end, the peripheral edge of the proximal end surface of the first sealing layer and the resistor locally approach each other and there may be cases where a desired resistance value is not obtained. Specifically, in the method for manufacturing a spark plug disclosed in JP-A-2010-135345, the resistance value of a manufactured spark plug varies among products, meaning that the difference between the resistance values of individual pieces is likely to be high.

In view of the foregoing, it is desired to have a method for manufacturing a spark plug in which the peripheral edge of a proximal end surface of a first sealing layer formed by sintering first electrically conductive glass powder is prevented from significantly rising toward the proximal end.

One aspect of the present disclosure provides a method for manufacturing a spark plug including a resistor. The method for manufacturing the spark plug includes: an electrode positioning step for positioning a center electrode in a shaft hole of an insulator; a first filling step for filling a space on a proximal end side of the center electrode in the shaft hole with first electrically conductive glass powder; a second filling step for filling a space on the proximal end side of the first electrically conductive glass powder in the shaft hole with resistor composition powder for forming the resistor; a third filling step for filling a space on the proximal end side of the resistor composition powder in the shaft hole with second electrically conductive glass powder; and a sintering step for sintering the first electrically conductive glass powder, the resistor composition powder, and the second electrically conductive glass powder in the shaft hole.

The method for manufacturing the spark plug includes, before the second filling step, a charge adjusting step for placing at least one of the insulator and the first electrically conductive glass powder in an uncharged state or placing the insulator and the first electrically conductive glass powder in the same charged state.

The method for manufacturing the spark plug according to the above aspect includes, before the second filling step for filling the shaft hole with the resistor composition powder, the charge adjusting step for placing at least one of the insulator and the electrically conductive glass powder in an uncharged state or placing the insulator and the electrically conductive glass powder in the same charged state. Therefore, the electrical adsorption of a portion of the electrically conductive glass powder on the inner surface of the insulator due to the insulator and the electrically conductive glass powder being charged to opposite polarities can be prevented after the charge adjusting step before the shaft hole is filled with the resistor composition powder. Thus, the peripheral edge of the proximal end surface of the first sealing layer can be prevented from being formed in such a shape as to significantly protrude toward the proximal end in a manufactured spark plug.

As just described, according to the above aspect, it is possible to provide a method for manufacturing a spark plug in which the peripheral edge of a proximal end surface of a first sealing layer formed by sintering first electrically conductive glass powder is prevented from significantly rising toward the proximal end.

Hereinafter, exemplary embodiments of the present disclosure will be described in detail with reference to the accompanying drawings, in which like reference numerals refer to like or similar elements regardless of reference numerals and duplicated description thereof will be omitted.

First Embodiment

An embodiment of a method for manufacturing a spark plug 1 is described with reference to FIGS. 1 to 3.

The method for manufacturing the spark plug 1 according to the present embodiment is a method for manufacturing the spark plug 1 including a resistor 8. First, with reference to FIG. 1, the structure of the spark plug 1 obtained by the manufacturing method according to the present embodiment is described. Note that in this description, a direction in which the center axis of the spark plug 1 extends is referred to as a plug axial direction X, one direction along the plug axial direction X in which a center electrode 3 protrudes from an insulator 2 is referred to as the distal end side, and the direction opposite thereto is referred to as the proximal end side.

The spark plug 1 includes: a cylindrical housing 6; the cylindrical insulator 2 held inside the housing 6; the center electrode 3 disposed inside the insulator 2; a first sealing layer 41; the resistor 8; a second sealing layer 42; and a terminal fitting 5.

The insulator 2 is made, for example, from a sintered ceramic body obtained by forming an insulating ceramic material such as alumina in a predetermined shape, followed by firing. The insulator 2 has a shaft hole 21 formed passing therethrough in the plug axial direction X at the center when viewed in the plug axial direction X. The shaft hole 21 includes a small-diameter portion 211, a step portion 212, and a large-diameter portion 213 in the order from the distal end side.

Each of the small-diameter portion 211 and the large-diameter portion 213 has a constant inner diameter in the plug axial direction X. The inner diameter of the large-diameter portion 213 is greater than the inner diameter of the small-diameter portion 211. The step portion 212 is formed to connect the small-diameter portion 211 and the large-diameter portion 213 and is tapered with a diameter increasing toward the proximal end.

The inner diameter of the large-diameter portion 213 is less than or equal to 3.8 mm. This is considered to be the maximum inner diameter of the large-diameter portion 213 that can be formed on the insulator 2 attachable to the housing 6 including a later-described attachment screw portion 61 having a thread diameter of at most M12 in consideration of the rigidity and the dielectric strength of the insulator 2; this belongs to a spark plug class in which the inner diameter of the large-diameter portion 213 is relatively small. In recent years, along with increases in the efficiency and output of engines, there has been a growing need for a reduction in the diameter of a spark plug that is used, in order to secure engine design flexibility, leading to demands for a reduction in the diameter of the insulator 2 and furthermore, a reduction in the diameter of the shaft hole 21, in order to reduce the diameter of the spark plug.

In the shaft hole 21, the center electrode 3, the first sealing layer 41, the resistor 8, the second sealing layer 42, and the terminal fitting 5 are arranged in the order from the distal end side. The center electrode 3 is formed in the shape of a rod and has a distal end portion protruding from the shaft hole 21. A proximal end portion 31 of the center electrode 3 is supported on the step portion 212 of the shaft hole 21 and thus, the center electrode 3 is positioned in the shaft hole 21. On the proximal end side of the center electrode 3 in the shaft hole 21 (in other words, at the large-diameter portion 213), the first sealing layer 41, the resistor 8, and the second sealing layer 42 are arranged in this order from the distal end side.

The first sealing layer 41 is made from a sintered body of first electrically conductive glass powder obtained by mixing glass with metal powder such as copper powder. The first sealing layer 41 is in close contact with the inner wall surface of the shaft hole 21 to ensure airtightness in the shaft hole 21. The first sealing layer 41 is in contact with the center electrode 3 at the distal end and is in contact with the resistor 8 at the proximal end, and the center electrode 3 and the resistor 8 are electrically connected via the first sealing layer 41.

The resistor 8 is made from a sintered body formed by sintering resistor composition powder obtained by mixing glass with resistor material powder such as carbon. The resistor 8 is used to prevent the occurrence of radio noise generated due to spark discharge of the spark plug 1 being transmitted to exterior to the spark plug 1. The resistivity of the resistor 8 in the plug axial direction X is greater than the resistivity of each of the first sealing layer 41 and the second sealing layer 42.

The second sealing layer 42 is made from a sintered body of second electrically conductive glass powder. Similar to the first electrically conductive glass powder, the second electrically conductive glass powder is copper-glass powder (specifically, powder obtained by mixing glass with metal powder such as copper powder). Second sealing layer 42 is in close contact with the inner wall surface of the large-diameter portion 213 of the shaft hole 21 to ensure airtightness in the shaft hole 21. The second sealing layer 42 is in contact with the resistor 8 at the distal end and is in contact with the terminal fitting 5 at the proximal end, and the resistor 8 and the terminal fitting 5 are electrically connected via the second sealing layer 42.

The boundary between the first sealing layer 41 and the resistor 8 and the boundary between the resistor 8 and the second sealing layer 42 can be checked on a cross-section including the center axis of the spark plug 1. In the shaft hole 21, the terminal fitting 5 is disposed adjacent to the proximal end of the second sealing layer 42.

The terminal fitting 5 is electrically connected to the center electrode 3 via the second sealing layer 42, the resistor 8, and the first sealing layer 41. The terminal fitting 5 includes: an inserted terminal portion 51 which is inserted in the shaft hole 21; and a protruding terminal portion 52 which protrudes from the shaft hole 21 toward the proximal end. The second sealing layer 42 is in close contact with the distal end of the inserted terminal portion 51. The distal end of the inserted terminal portion 51 is threaded in order to improve the adhesion with the second sealing layer 42. Furthermore, the outer diameter of the inserted terminal portion 51 is less than the inner diameter of the shaft hole 21, and the second sealing layer 42 is also disposed between the distal end of the inserted terminal portion 51 and the shaft hole 21. The protruding terminal portion 52 is a terminal used for connecting the spark plug 1 to an ignition coil.

The insulator 2 is held in the housing 6. The housing 6 is cylindrically shaped and made by forming a heat-resistant metal material such as an ion-based alloy. An attachment screw portion 61 for screwing the housing 6 into a female threaded hole provided in a plug hole of a cylinder head of an internal combustion engine is formed on an outer peripheral portion of the housing 6.

An earth electrode 7 is connected to the distal end of the housing 6. The earth electrode 7 faces the center electrode 3 in the plug axial direction X and forms a discharge gap G between the center electrode 3 and the earth electrode 7 in the plug axial direction X. Application of a high voltage to the center electrode 3 causes spark discharge in the discharge gap G, and thus an air-fuel mixture in a combustion chamber is ignited.

Next, with reference to FIGS. 2A-2H, a method for manufacturing the spark plug 1 according to the present embodiment is described.

The present embodiment describes a method for forming the center electrode 3, the first sealing layer 41, the resistor 8, the second sealing layer 42, and the terminal fitting 5 inside the insulator 2.

Figures 2A, 2B, 2C, 2D, 2E, 2F, 2G, 2H:
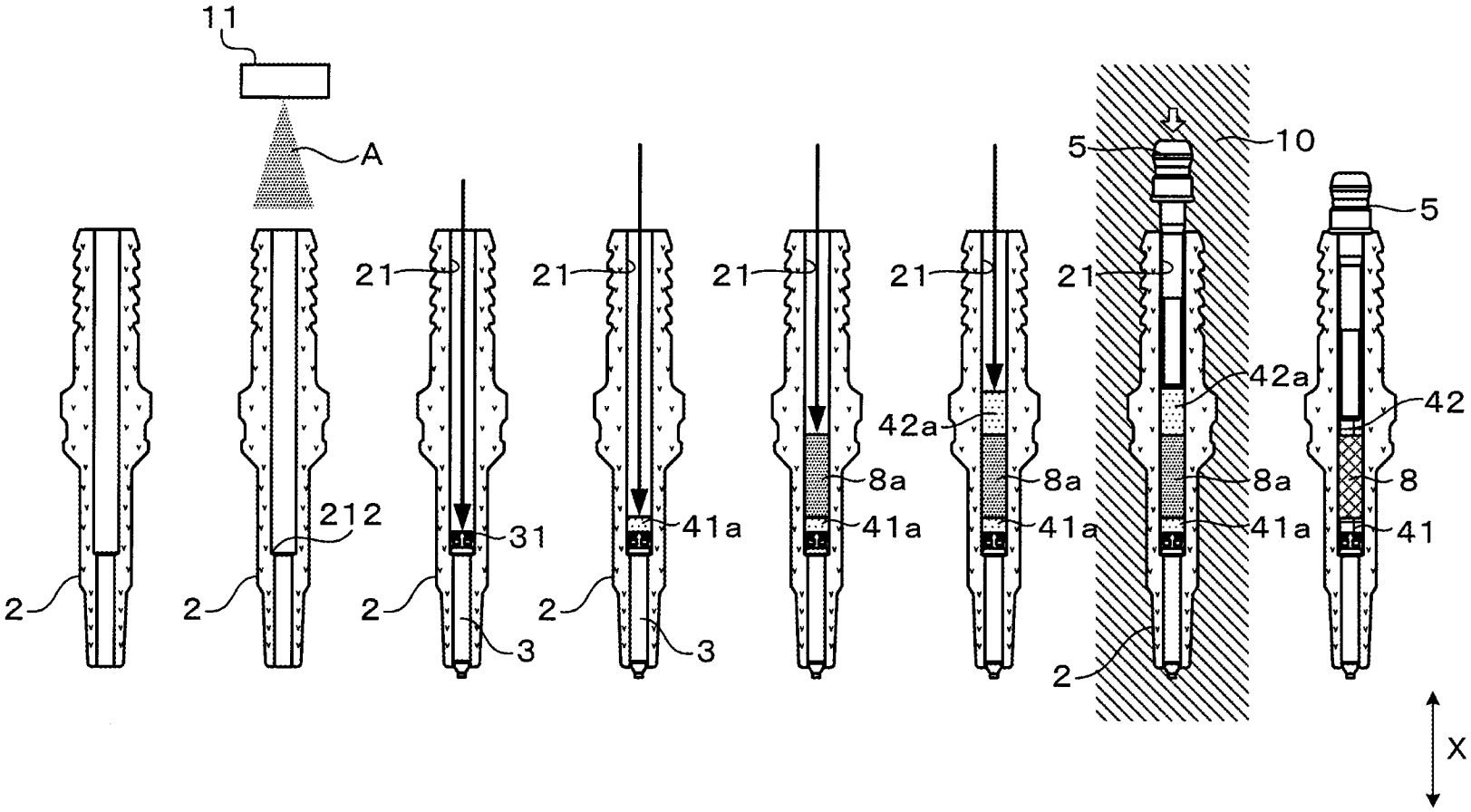
FIG. 2A-2H are cross-sectional views for explaining a method for manufacturing the spark plug according to the first embodiment.

First, as shown in FIG. 2A, a preparation step is performed to prepare the insulator 2 manufactured, for example, at a site different from a site at which the present method is implemented. Here, there is the concern that the insulator 2 is charged, for example, by friction that occurs during transportation from the manufacturing site. Therefore, the preparation step is followed by a charge adjusting step shown in FIG. 2B.

The charge adjusting step is performed to prevent the insulator 2 and the first electrically conductive glass powder from being charged to opposite polarities. As shown in FIG. 2B, in the present embodiment, the charge adjusting step is to neutralize the insulator 2 to place the insulator 2 in an uncharged state. The charge neutralization of the insulator 2 is performed using a charge neutralizer 11. As the charge neutralizer 11, a device that includes a needle electrode and generates ions around the needle electrode by applying a voltage thereto can be used. Furthermore, the charge neutralizer 11 may diffuse the generated ions using a jet of air A.

For example, a known pulsed AC, AC, DC, or pulsed DC ionizer may be used as the charge neutralizer 11. By using the charge neutralizer 11 of these types, the amount of charge in the insulator 2 can be rapidly neutralized to the vicinity of 0 nC (nanocoulomb) with ease. Note that another method can be used as a charge neutralization method.

The charge neutralization is performed on the inner wall of the shaft hole 21 of the insulator 2. Specifically, using the jet of air A, the ions generated by the charge neutralizer 11 are sprayed on the inside of the shaft hole 21 to neutralize the insulator 2. The charge adjusting step is performed on the separate insulator 2 to which other members such as the center electrode 3 have not been attached. Thus, the jet of air A can be sprayed on the inside of the insulator 2 in such a manner as to pass through the shaft hole 21, facilitating the charge neutralization of the insulator 2. The charge adjusting step is followed by an electrode positioning step, as shown in FIG. 2C.

As shown in FIG. 2C, in the electrode positioning step, the center electrode 3 is inserted into the shaft hole 21 from the proximal end of the shaft hole 21 of the insulator 2. The center electrode 3 is held in the shaft hole 21 with the proximal end portion 31 of the center electrode 3 supported on the step portion (refer to reference sign 212 in FIG. 2B) of the shaft hole 21. Next, as shown in FIG. 2D, a first filling step is performed.

As shown in FIG. 2D, in the first filling step, a space on the proximal end side of the center electrode 3 in the shaft hole 21 is filled with first electrically conductive glass powder 41*a* (copper glass powder) for forming the first sealing layer 41. At this time, the insulator 2 is in the uncharged state as a result of the charge adjusting step, and thus the first electrically conductive glass powder 41*a* is not electrically adsorbed on the inside of the shaft hole 21 of the insulator 2.

Subsequently, a rod jig not shown in the drawings is inserted into the shaft hole 21 and pressurizes the first electrically conductive glass powder 41*a* toward the distal end. In order to allow the insertion into the shaft hole 21, the jig is formed to have a diameter slightly smaller than the inner diameter of a portion of the shaft hole 21 at which the first electrically conductive glass powder 41*a* is positioned. Note that in a method for manufacturing a spark plug that does not include the charge adjusting step unlike the method according to the present embodiment, in the case where a portion of the electrically conductive glass powder is electrically adsorbed to the shaft hole, even if the jig is inserted into the shaft hole, the electrically conductive glass powder adsorbed to the shaft hole can not be removed.

Furthermore, in the present embodiment, after the first electrically conductive glass powder 41*a* is pressurized using the jig, a second filling step is performed, as shown in FIG. 2E.

As shown in FIG. 2E, the second filling step is to fill a space on the proximal end side of the first electrically conductive glass powder 41*a* in the shaft hole 21 with resistor composition powder 8*a* for forming the resistor 8. Subsequently, a rod jig not shown in the drawings is inserted into the shaft hole 21 and pressurizes the resistor composition powder 8*a* toward the distal end. Next, as shown in FIG. 2F, a third filling step is performed.

As shown in FIG. 2F, the third filling step is to fill a space on the proximal end side of the resistor composition powder 8*a* in the shaft hole 21 with second electrically conductive glass powder 42*a*. Subsequently, a rod jig not shown in the drawings is inserted into the shaft hole 21 and pressurizes the second electrically conductive glass powder 42*a* toward the distal end. Thus, the first electrically conductive glass powder 41*a*, the resistor composition powder 8*a*, and the second electrically conductive glass powder 42*a* are stacked in this order on the proximal end side of the center electrode 3 in the shaft hole 21.

Following the third filling step, the terminal fitting 5 is inserted into the shaft hole 21 from the proximal end of the shaft hole 21. In this state, the terminal fitting 5 is disposed on the proximal end side of the final position thereof relative to the insulator 2. In the next sintering step, the terminal fitting 5 is pressed toward the distal end and disposed at the final position in the completed spark plug 1.

As shown in FIG. 2G, the sintering step is to sinter the first electrically conductive glass powder 41*a*, the resistor composition powder 8*a*, and the second electrically conductive glass powder 42*a*. The sintering step is performed, for example, in a heating furnace 10 having a temperature higher than or equal to the softening temperatures of glass materials of the first electrically conductive glass powder 41*a*, the resistor composition powder 8*a*, and the second electrically conductive glass powder 42*a*. Thus, the first electrically conductive glass powder 41*a*, the resistor composition powder 8*a*, and the second electrically conductive glass powder 42*a* are softened and become fluid. In the state where these are fluid, the terminal fitting 5 is pressed toward the distal end.

As a result of pressing the terminal fitting 5 toward the distal end, the fluid of the second electrically conductive glass powder 42*a* flows into a gap between the shaft hole 21 and the outer periphery of the inserted terminal portion 51 of the terminal fitting 5, and thus the adhesion between the terminal fitting 5 and the fluid of the second electrically conductive glass powder 42*a* improves. Furthermore, the temperature in the heating furnace 10 is reduced so that the fluid of the first electrically conductive glass powder 41*a*, the fluid of the resistor composition powder 8*a*, and the fluid of the second electrically conductive glass powder 42*a* are solidified, resulting in the first sealing layer 41, the resistor 8, and the second sealing layer 42, as shown in FIG. 2H. Specifically, the first electrically conductive glass powder 41*a* is sintered into the first sealing layer 41, the resistor composition powder 8*a* is sintered into the resistor 8, and the second electrically conductive glass powder 42*a* is sintered into the second sealing layer 42.

Figure 3:
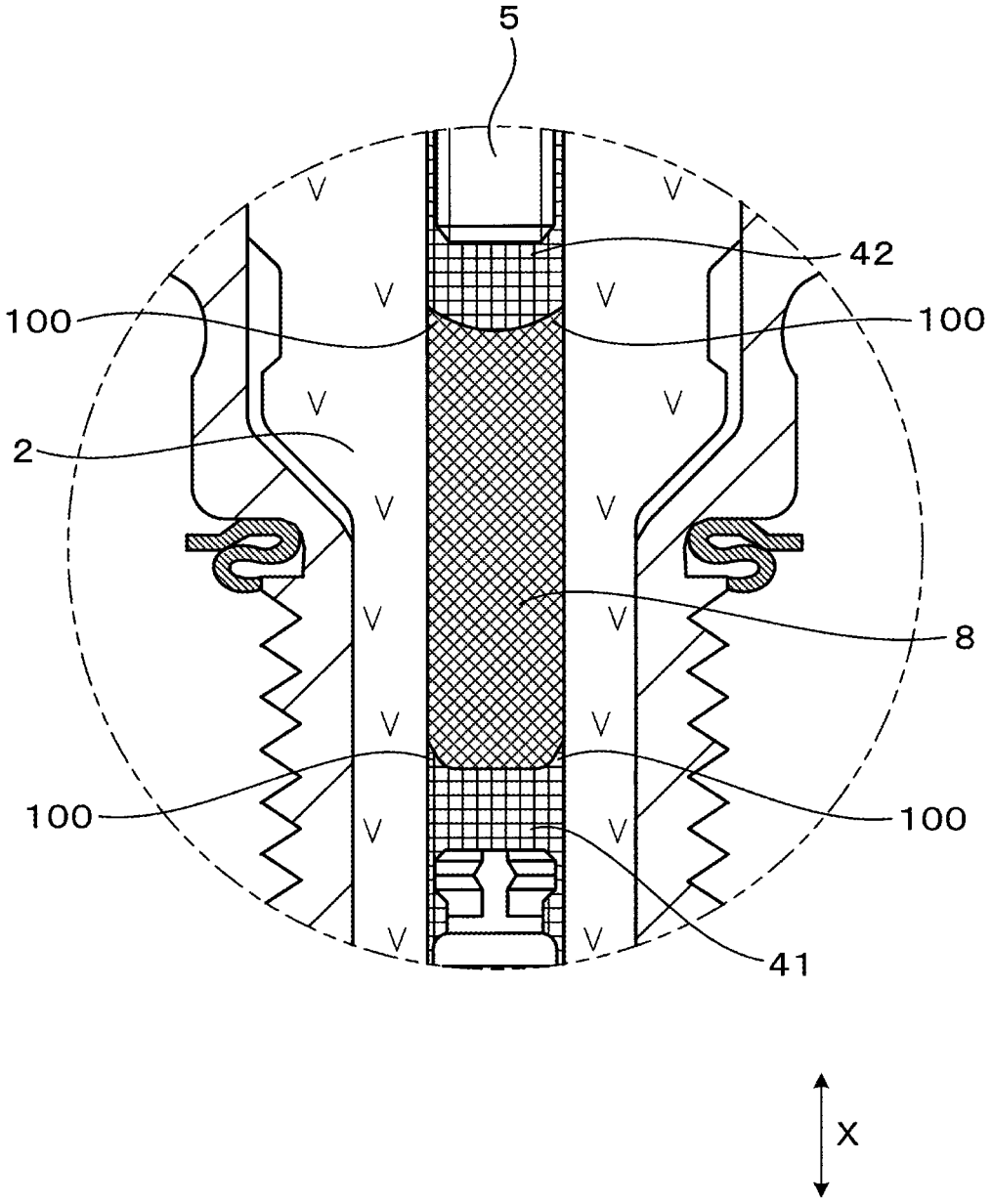
FIG. 3 is an enlarged cross-sectional view of the spark plug around a resistor according to the first embodiment.

Note that as schematically shown in FIG. 3, also in the present embodiment, pressing the terminal fitting 5 in the insulator 2 toward the distal end in the sintering step may result in formation of a rising portion 100, which slightly protrudes toward the proximal end, on both the peripheral edge of the proximal end surface of the first sealing layer 41 and the peripheral edge of the proximal end surface of the resistor 8.

As described above, the center electrode 3, the first sealing layer 41, the resistor 8, the second sealing layer 42, and the terminal fitting 5 can be formed inside the insulator 2.

Next, the effects produced in the present embodiment are described.

The method for manufacturing the spark plug 1 according to the present embodiment includes the charge adjusting step for placing the insulator 2 in the uncharged state before the second filling step for filling the shaft hole 21 with the resistor composition powder 8*a*. Therefore, the electrical adsorption of a portion of the electrically conductive glass powder on the inner surface of the insulator 2 due to the insulator 2 and the electrically conductive glass powder being charged to opposite polarities can be prevented after the charge adjusting step before the shaft hole 21 is filled with the resistor composition powder 8*a*. Thus, the peripheral edge of the proximal end surface of the first sealing layer 41 can be prevented from being formed in such a shape as to significantly protrude toward the proximal end in the manufactured spark plug 1.

Figure 4:
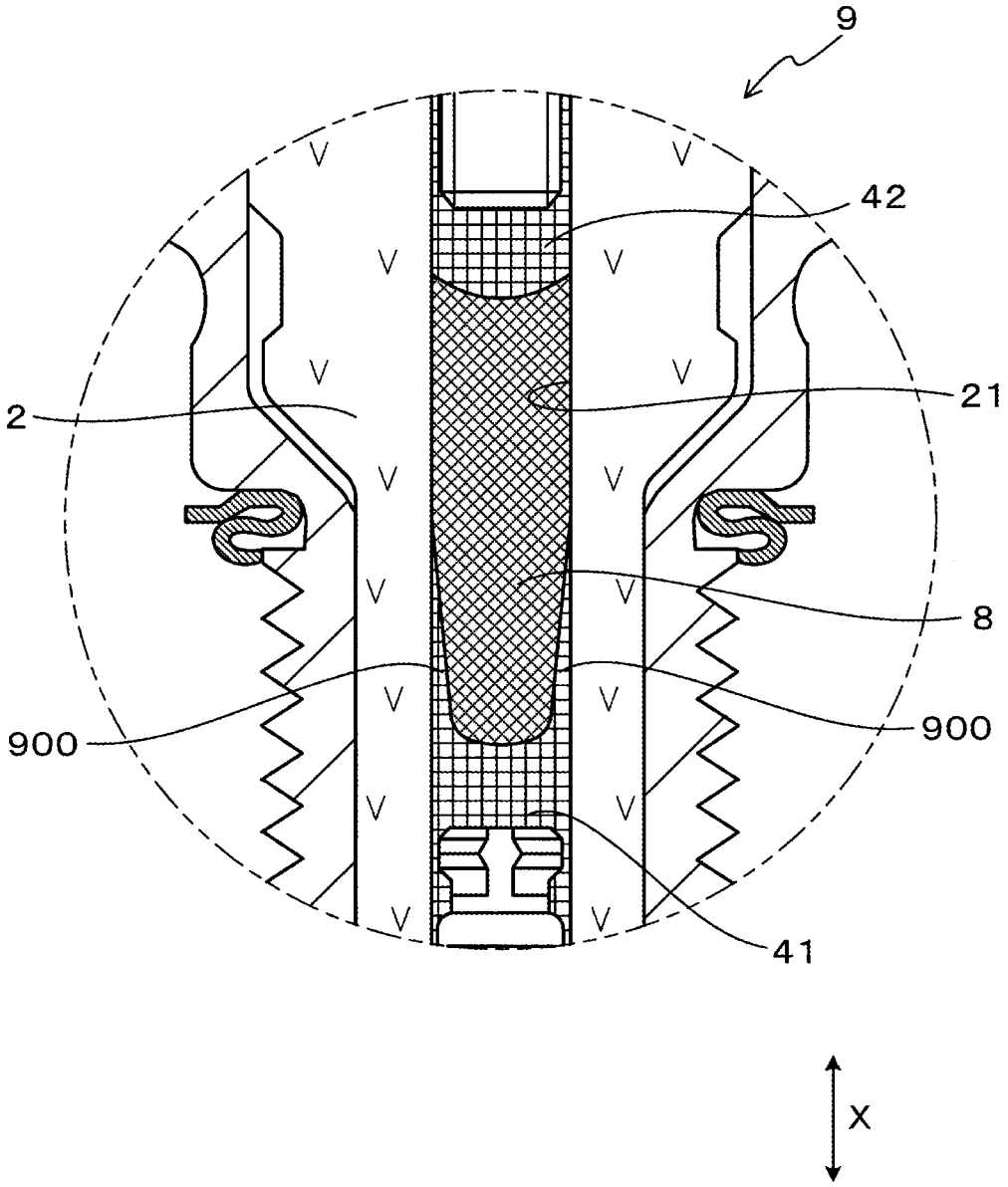
FIG. 4 is an enlarged cross-sectional view of a spark plug around a resistor according to a comparative embodiment.

On the other hand, as shown in FIG. 4, unlike the present disclosure, in a spark plug 9 manufactured by the manufacturing method that does not include the charge adjusting step, the insulator 2 may be charged, for example, before the insulator 2 is filled with the first electrically conductive glass powder which constitutes the first sealing layer 41. In this case, if the inside of the insulator 2 is filled with the first electrically conductive glass powder, a portion of the first electrically conductive glass powder is electrically adsorbed on the inside of the shaft hole 21. Accordingly, in the manufactured spark plug 9, there is a risk that a rising portion 900 which protrudes significantly further toward the proximal end than the surroundings may be formed on the peripheral edge of the proximal end surface of the first sealing layer 41. In the case where such a large rising portion is formed, the resistance between the rising portion of the first sealing layer 41 and the second sealing layer 42 may have a locally small value, resulting in a failure to obtain a desired resistance value. In other words, the resistance value of the manufactured spark plug 9 may vary among products, meaning that the difference between the resistance values of individual pieces is likely to be high.

Therefore, when the charge adjusting step is performed before the second filling step as in the present embodiment, the peripheral edge of the proximal end surface of the first sealing layer 41 can be prevented from being formed in such a shape as to significantly protrude toward the proximal end, and the products are likely to have the same resistance value.

Furthermore, the charge adjusting step is to place at least one of the insulator 2 and the first electrically conductive glass powder 41*a* in the uncharged state by charge neutralization. Therefore, in the charge adjusting step, it is sufficient that at least one of the insulator 2 and the first electrically conductive glass powder 41*a* be neutralized; thus, the step can be easily simplified.

The charge neutralization of the insulator 2 is performed on the inner wall of the shaft hole 21 of the insulator 2. Therefore, the occurrence of the peripheral edge of the proximal end surface of the first sealing layer 41 significantly rising toward the proximal end is more likely to be reduced. Specifically, in the case where the inner wall of the shaft hole 21 of the insulator 2 is charged, a portion of the first electrically conductive glass powder 41*a* easily electrically adsorbs on the inner wall of the shaft hole 21 in the state where the shaft hole 21 is filled with the first electrically conductive glass powder 41*a*. Thus, the inner wall of the shaft hole 21 is neutralized so that the peripheral edge of the proximal end surface of the first sealing layer 41 in the manufactured spark plug 1 does not significantly protrude toward the proximal end due to the electrically conductive glass powder adsorbing to the shaft hole 21.

Furthermore, a portion (namely, the large-diameter portion 213) of the shaft hole 21 at which the first electrically conductive glass powder 41*a* is provided has an inner diameter of no more than 3.8 mm. In other words, as mentioned earlier, the inner diameter of the large-diameter portion 213 is less than or equal to the maximum inner diameter of the shaft hole 21 that can be formed on the insulator 2 attachable to the housing 6 including the attachment screw portion 61 having a thread diameter of at most M12 in consideration of the rigidity and the dielectric strength of the insulator 2. Thus, the large-diameter portion 213 is formed relatively small, allowing for a reduction in the diameter of the spark plug 1.

On the other hand, in the first filling step for filling the shaft hole 21 with the first electrically conductive glass powder 41*a*, the smaller the large-diameter portion 213 is, the more likely each part of the electrically conductive glass powder is to approach the inner wall of the shaft hole 21, causing more concern about significant rising of the peripheral edge of the proximal end surface of the first sealing layer 41 in the manufactured spark plug 1 toward the proximal end. Even in the spark plug 1 with such a high concern, by performing the charge adjusting step before the second filling step as mentioned earlier, the peripheral edge of the proximal end surface of the first sealing layer 41 can be effectively prevented from being formed in such a shape as to significantly protrude toward the proximal end.

As just described, according to the present embodiment, it is possible to provide a method for manufacturing a spark plug in which the peripheral edge of a proximal end surface of a first sealing layer is prevented from significantly rising toward the proximal end.

Second Embodiment

The present embodiment is obtained by changing the charge adjusting step in the first embodiment.

The charge adjusting step according to the present embodiment is to place the insulator 2 and the first electrically conductive glass powder 41*a* in the same charged state before the second filling step. For example, in the charge adjusting step, both the inner surface of at least the shaft hole 21 of the insulator 2 and the first electrically conductive glass powder 41*a* are positively or negatively charged.

The other details are the same as or similar to those in the first embodiment.

Note that among reference signs used in the second embodiment and subsequent embodiments, reference signs that are the same as those used in the previously described embodiment represent structural elements and the like that are the same as or similar to those in the previously described embodiment unless otherwise noted.

In the present embodiment, the charge adjusting step for placing the insulator 2 and the first electrically conductive glass powder 41*a* in the same charged state is performed before the second filling step. Therefore, the force of repulsion acts between the inner wall of the insulator 2 and the first electrically conductive glass powder 41*a*, preventing the peripheral edge of the proximal end surface of the first sealing layer 41 in the manufactured spark plug 1 from significantly rising toward the proximal end due to the first electrically conductive glass powder 41*a* electrically adsorbed on the inside of the shaft hole 21 in the first filling step.

Aside from this, substantially the same effects as those in the first embodiment are produced.

Third Embodiment

The present embodiment is obtained by changing the charge adjusting step in Embodiments 1 and 2.

In the present embodiment, the charge adjusting step is to, after manufacture of the insulator 2, store the insulator 2 in an electrically conductive container or on a metal mesh, for example, and avoid charging of the insulator 2 in the first place.

The other details are the same as or similar to those in the first embodiment.

In the present embodiment, substantially the same effects as those in the first embodiment are produced as well.

OTHER EMBODIMENTS

The present disclosure is not limited to each of the above-described embodiments and can be applied to various embodiments without departing from the principles and spirit of the present disclosure.

For example, although the charge neutralization of the insulator 2 is performed on the inner wall of the shaft hole 21 as the charge adjusting step in the first embodiment, the charge neutralization can be performed from outside of the insulator 2, for example, by spraying the jet of air A from the charge neutralizer 11 onto the outside of the insulator 2. In this case, it may take longer time to neutralize the inner wall of the shaft hole 21 than in the case where the inner wall of the shaft hole 21 is directly neutralized, but the insulator 2 can be neutralized from the outside of the insulator 2.

Furthermore, although the charge adjusting step is performed before the electrode positioning step for positioning the center electrode 3 in the insulator 2 in each of the above-described embodiments, this is not limiting as long as the charge adjusting step is performed before the second filling step for filling the shaft hole 21 with the resistor composition powder 8*a*. For example, the charge adjusting step may be performed immediately after the electrode positioning step or may be performed after the first filling step for filling the shaft hole 21 with the first electrically conductive glass powder 41*a* before the second filling step.

What is claimed is:

1. A method for manufacturing a spark plug including a resistor, the method comprising:

an electrode positioning step for positioning a center electrode in a shaft hole of an insulator;

a first filling step for filling a space on a proximal end side of the center electrode in the shaft hole with first electrically conductive glass powder;

a second filling step for filling a space on the proximal end side of the first electrically conductive glass powder in the shaft hole with resistor composition powder for forming the resistor;

a third filling step for filling a space on the proximal end side of the resistor composition powder in the shaft hole with second electrically conductive glass powder; and a sintering step for sintering the first electrically conductive glass powder, the resistor composition powder, and the second electrically conductive glass powder in the shaft hole; and a charge adjusting step, prior to the second filling step, for placing at least one of the insulator and the first electrically conductive glass powder in an uncharged state or placing the insulator and the first electrically conductive glass powder in the same charged state.

2. The method for manufacturing the spark plug according to claim 1, wherein the charge adjusting step comprises placing at least one of the insulator and the first electrically conductive glass powder in the uncharged state by charge neutralization.

3. The method for manufacturing the spark plug according to claim 2, wherein the charge neutralization is performed on an inner wall of the shaft hole of the insulator.

4. The method for manufacturing the spark plug according to claim 1, wherein a portion of the shaft hole where the first electrically conductive glass powder is provided has an inner diameter of no more than 3.8 mm.

5. The method for manufacturing the spark plug according to claim 1, wherein the charge adjusting step comprises placing the insulator and the first electrically conductive glass powder in the same charged state such that a force of repulsion acts between the insulator and the first electrically conductive glass powder.

* * * * *